US006123387A

United States Patent [19]

Kelly

[11] Patent Number: 6,123,387

[45] Date of Patent: Sep. 26, 2000

[54] CHAIR WITH KEYBOARD AND MOUSE PLATFORMS

[76] Inventor: Joseph L. Kelly, 5836 92$^{nd}$ Ter. North, Pinellas Park, Fla. 33782-4906

[21] Appl. No.: 09/427,911

[22] Filed: Oct. 27, 1999

[51] Int. Cl.$^{7}$ ..... A47C 7/62

[52] U.S. Cl. ..... 297/188.18; 297/188.21

[58] Field of Search ..... 297/170, 173, 297/174, 135, 188.01, 188.14, 188.18, 188.2, 188.21; 248/415, 289.11, 291.1

[56] References Cited

U.S. PATENT DOCUMENTS

| | | |
|---|---|---|
| 564,044 | 7/1896 | Berkemeyer . |
| 818,917 | 4/1906 | Ruger . |
| 3,206,775 | 9/1965 | Filson . |
| 5,116,098 | 5/1992 | Wooten . |
| 5,653,499 | 8/1997 | Goodall . |
| 5,909,864 | 6/1999 | Wang . |

FOREIGN PATENT DOCUMENTS

| | | |
|---|---|---|
| 292824 | 6/1928 | United Kingdom . |

*Primary Examiner*—Milton Nelson, Jr.
*Attorney, Agent, or Firm*—Ronald E. Smith; Smith & Hopen, P.A.

[57] ABSTRACT

A chair for use by computer users includes a first platform for supporting a computer keyboard and a second platform for supporting a computer mouse. Both platforms are connected to a preselected armrest of the chair. The first platform is pivotally mounted in a horizontal plane so that it can be swung out of position to enable a user to get out of the chair and so that it can be swung back into its operable position when the user has reentered the chair. The first platform is also tiltable about a horizontal axis to enable the user to adjust its orientation to a comfortable position. The second platform is mounted to a left armrest to comfortably position the mouse for left-handed users and to a right armrest for right-handed users.

3 Claims, 5 Drawing Sheets

CHAIR WITH KEYBOARD AND MOUSE PLATFORMS

BACKGROUND OF THE INVENTION

1. Field of the Invention

This invention relates, generally, to furniture having utility in connection with computers. More particularly, it relates to a chair for computer users that has platforms for supporting a computer keyboard and a computer mouse.

2. Description of the Prior Art

Most personal computer installations require a user to sit in a conventional chair in front of a keyboard that is positioned on a desk top. A mouse for controlling the cursor is typically supported by the same desk top. As a result, the individual is restricted in movement, being confined to the chair so that he or she can reach the keyboard and the mouse. The chair itself cannot be moved far, either, because if it is placed at a distance away from the keyboard and mouse, those items become inaccessible.

Since the modern workplace requires people to be near a keyboard and a mouse all day long, it would be helpful if computer-related furniture were not so restrictive.

A few inventors have addressed this problem. However, the solutions that have heretofore been found include complex mechanisms that are impractical from a cost standpoint. Significantly, the earlier solutions require specially built chairs.

Thus, there remains a need for a practical, inexpensive structure that provides an enhanced degree of freedom to a computer user seated in a chair. More particularly, there is a need for a structure that could be retrofit to an existing conventional chair so that the cost of the final product would not be prohibitive.

However, it was not obvious to those of ordinary skill in this art how the needed improvements could be provided, in view of the art considered as a whole at the time the present invention was made.

SUMMARY OF THE INVENTION

The long-standing but heretofore unfulfilled need for an innovation that overcomes the limitations of the prior art is now met by a new, useful, and nonobvious invention. The present invention is an assembly adapted for attachment to a chair. It includes a first platform adapted to support a computer keyboard and a second platform adapted to support a computer mouse. Both platforms are releasably secured to a preselected armrest of the chair. The keyboard-supporting platform may be connected to either armrest but the mouse-supporting platform is connected to a left armrest for a left-handed mouse user and to the right armrest for a right-handed mouse user.

The novel structure enables a person seated on the chair to operate the keyboard and the computer mouse while seated in the chair. The person may sit comfortably in the chair in any desired posture or orientation without regard to physical placement of a computer means or a computer monitor means with which the computer keyboard and computer mouse are associated.

Although the novel assembly may be retrofit to any chair having armrests, the preferred chair for use with the inventive assembly is an ergonomically-designed chair having multiple features for enhancing safety and comfort. Such features include a pneumatic height adjustment, coasters that provide mobility throughout an office, a three hundred sixty degree swivel to allow access to an entire work area, a tilt tension adjustment means, contoured seat and back rest parts, and the like.

The first platform is supported by a pivot means; the pivot means has a first part for enabling pivoting of the first platform in a substantially horizontal plane. The first platform has a first position where it is disposed transversely relative to the chair so that the computer keyboard adapted to be supported thereby is positioned directly in front of a user seated in the chair. The first platform has a second position where it is disposed longitudinally relative to the chair to enable a person seated in the chair to get out of the chair and to enable a person not seated in the chair to get into the chair.

The pivot means has a second part enabling the first platform to rotate about a substantially horizontal axis so that a user of the computer keyboard may rotate the first platform into a preselected plane that is tilted by any preselected degree relative to a horizontal plane.

An elongate support arm has a proximal end adapted to be secured to a preselected armrest of a chair and a distal end to which a bracket is secured. The bracket is adapted to provide the pivoting of the first platform in the substantially horizontal plane and to provide the tilting of the first platform about the substantially horizontal axis.

The bracket has an "L"-shaped structure and includes a substantially horizontal first part and a substantially vertical second part.

A support plate is disposed in a substantially horizontal plane in underlying, supporting relation to the first platform and a mounting ear depends from a preselected longitudinal edge of the support plate. The mounting ear pivotally engages the substantially vertical part of the bracket so that the support plate and hence the first platform are conjointly rotatable about the substantially horizontal axis.

The substantially horizontal first part of the bracket is pivotally engaged to the distal end of the elongate support arm so that the support plate and hence the first platform are conjointly rotatable about a substantially vertical axis and thus conjointly pivotal in the substantially horizontal plane.

A flat mounting plate depends from a preselected edge of the second platform, and an elongate mounting tube having a blind bore formed therein is secured to a bottom edge of the flat mounting plate. An elongate rod is slideably received within the blind bore. A base member to which the elongate rod is secured is adapted to releasably engage a preselected armrest of the chair. An anti-rotation means is provided to prevent rotation of the second platform about the elongate arm so that the second platform remains in a horizontal plane in cantilevered relation to the elongate arm.

It is a primary object of this invention to provide a chair in which a computer user can comfortably sit while operating a computer keyboard and a computer mouse without being confined to the immediate vicinity of a desk top.

Another object is to provide the needed structure in a way that incorporates a commercially-available chair so that the product is economical to manufacture and thus affordable by consumers.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
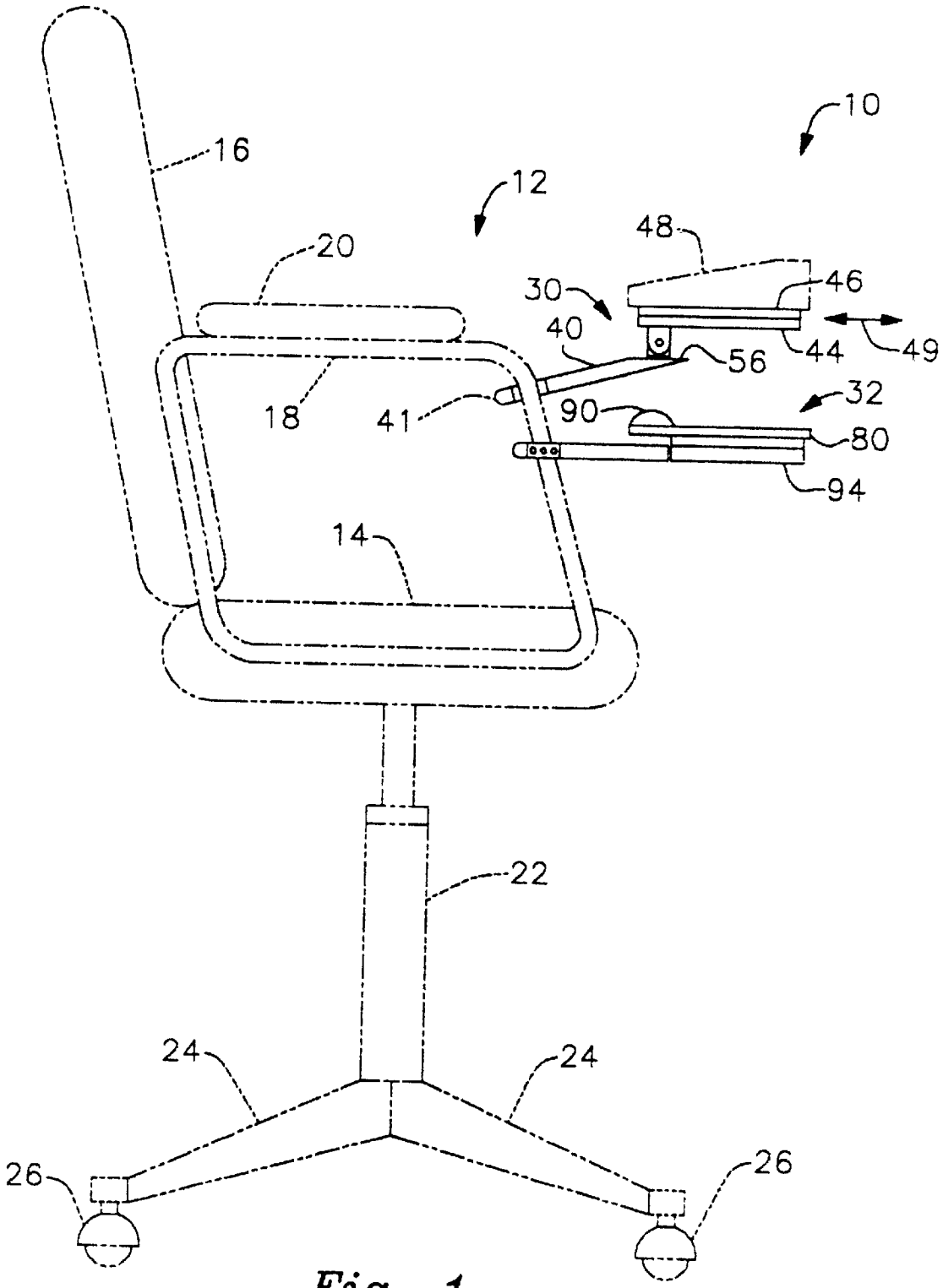
FIG. 1 is a side elevational view of the novel structure when attached to a conventional office chair.

Referring now to FIG. 1, it will there be seen that an exemplary embodiment of the invention is denoted as a whole by the reference numeral 10.

Office chair 12 is depicted in phantom lines because it is a commercially-available, ergonomically-designed chair having numerous features for enhancing the safety and comfort of its user. It includes a seat 14, a back rest 16, armrests 18 having cushions 20, a telescoping pedestal 22 having pneumatic adjustment means for adjusting the height of seat 14, and radiating legs 24 supported at their respective outermost ends by casters 26.

Reference numeral 30 indicates the structure, as a whole, that supports a computer keyboard and reference numeral 32 indicates the structure that supports a computer mouse. In this particular configuration, keyboard support structure 30 is secured to a forward section of a left armrest and mouse support structure 32 is secured to a forward section of a right armrest.

However, it should be understood from the outset that the novel structure of this invention has utility for both right-handed and left-handed users. The armrest to which keyboard support structure 30 is attached is irrelevant for right or left-handers, so structure 30 can be attached to the left or right armrest for all users. For those who prefer to handle a mouse with their left hand, a mirror image of mouse-supporting structure 32 is attached to the forward section of the left armrest.

Figure 2:
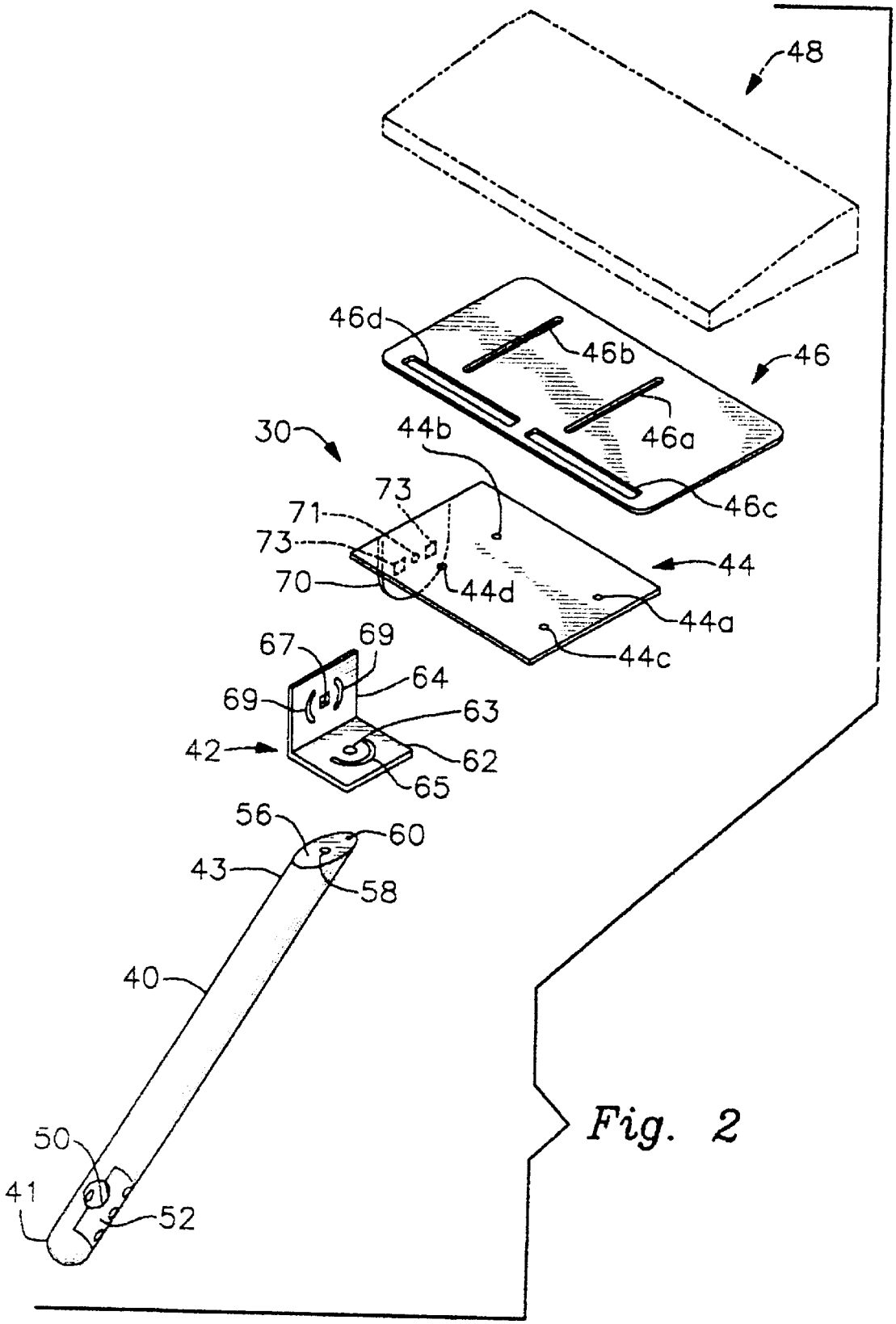
FIG. 2 is an exploded perspective view of the structure for supporting a keyboard.

The individual parts that collectively provide keyboard-supporting structure 30 are best depicted in FIG. 2. The parts include an elongate rigid support arm 40, an "L"-shaped bracket 42, a support plate 44, and a base plate 46. A keyboard 48 is depicted in phantom lines because it forms no part of the invention, per se.

A throughbore 50 is formed at a predetermined angle relative to a longitudinal axis of symmetry of support arm 40 in proximal end 41 of said support arm to receive the forward section of armrest 18.

Figure 3:
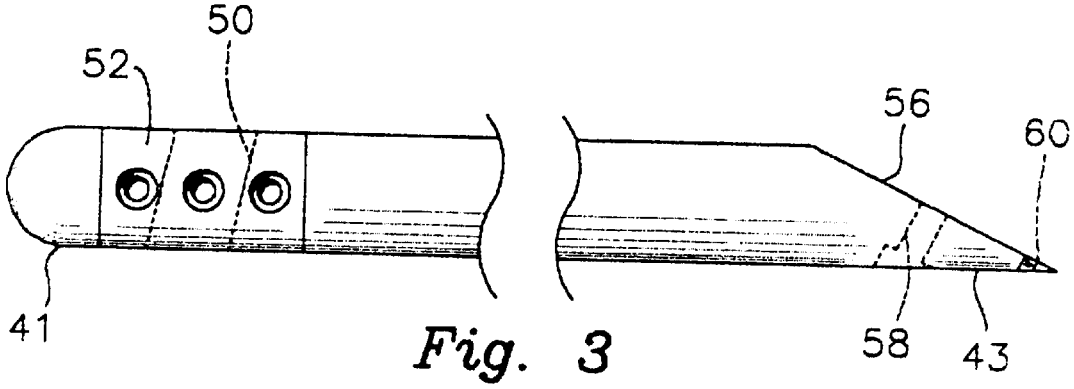
FIG. 3 is a broken apart side elevational view of an elongate arm that forms a part of the novel keyboard support structure.
Figure 4:
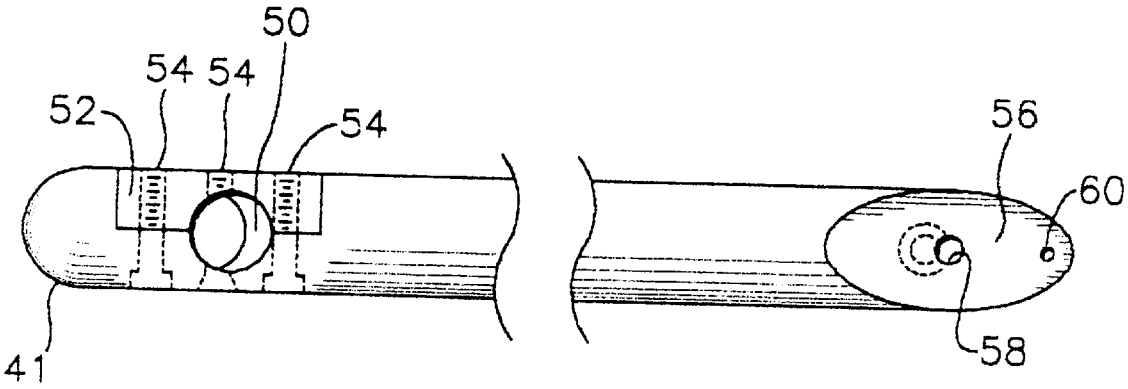
FIG. 4 is a broken apart top plan view of the elongate arm depicted in FIG. 3.

More particularly, as indicated in FIGS. 2–4, a cut-out part 52 is cut out of said proximal end. The cut-out extends to about the center of support arm 40 so that about half of bore 50 is formed in proximal end 41 and about half of said bore is formed in cut-out part 52 as perhaps best illustrated in FIG. 4. A plurality of screws, collectively denoted 54, secure cut-out part 52 to proximal end 41, thereby sandwiching the forward section of armrest 18 therebetween.

Distal end 43 of elongate arm 40 has a beveled surface 56 formed therein. Primary bore 58 and secondary bore 60 are formed in said distal end 43 at a predetermined common angle so that they are in open communication with beveled surface 56. Primary bore 58 is substantially centered with respect to beveled surface 56 and secondary bore 60 is near the peripheral edge thereof.

"L"-shaped bracket 42 includes a bottom wall 62 and a side wall 64 disposed normal thereto. Bottom wall 62 has a central aperture 63 and an arcuate opening 65 formed therein. Side wall 64 has a square central aperture 67 formed therein that is flanked by a symmetrical pair of arcuate openings, collectively denoted 69.

A pivot pin means, not shown, interconnects primary bore 58 formed in distal end 43 of elongate arm 40 and central aperture 63 formed in bottom wall 62 so that bottom wall 62 is free to rotate about said pivot pin means. A guide pin, not shown, interconnects secondary bore 60 and arcuate opening 65 to limit the range of said rotation. The guide pin is provided in the form of a screw so that it can be loosened or tightened to allow or lock against, respectively, rotation of bottom wall 62 with respect to elongate arm 40.

Note from FIG. 1 that the angle of throughbore 50 and the angle of beveled surface 56 are mutually preselected so that beveled surface 56 is disposed in a substantially horizontal plane when the proximal end 41 of elongate arm 40 is secured to the forward section of chair arm 18.

Support plate 44 has four apertures formed therein, denoted 44*a–d*.

A mounting ear 70 depends from an outboard edge of support plate 44 and three apertures are formed in said mounting ear. The central aperture is denoted 71 and the flanking apertures, of square configuration, are collectively denoted 73. Mounting ear 70 is placed into overlying juxtaposition with side wall 64 of "L"-shaped bracket 42 on the inboard side thereof when the novel device is assembled.

A central pivot pin having a square head interconnects square central opening 67 formed in bracket 42 and central opening 71 formed in mounting ear 70 so that support plate 44 is rotatable about said central pivot pin. The square head fits within square opening 67 and is therefore held against rotation. Similarly, a pair of guide pins have square heads that fit within square apertures 73 formed in mounting ear 70. These square-headed guide pins extend through arcuate openings 69, 69 formed in bracket side wall 64 and thus limit rotation of support plate 44 with respect to said side wall.

Longitudinally extending slots 46*a*, 46*b* formed in base plate 46 enable forward and rearward displacement of said base plate and hence of keyboard 48, as indicated by double-headed directional arrow 49 in FIG. 1. Laterally extending slots 46*c*, 46*d* enable lateral (transverse) motion thereof. These slots receive pins, not shown, that are positioned in apertures 44*a–d* formed in support plate 46.

Loosening the guide pin that extends through arcuate opening 65 formed in bottom wall 62 of bracket 42 and into bore 60 formed in bevel surface 56 of support arm 40 enables keyboard 48 and the just-described structure that supports it to be swung out of the way when a user is entering or leaving chair 12. The pivotal motion of keyboard 48 and said supporting parts is about the vertical pivot pin that extends through bore 58 of support arm 40 and central bore 63 of bottom wall 62. Such pivotal motion is thus in a substantially horizontal plane when chair 12 is supported on a substantially level support surface.

Figure 5:
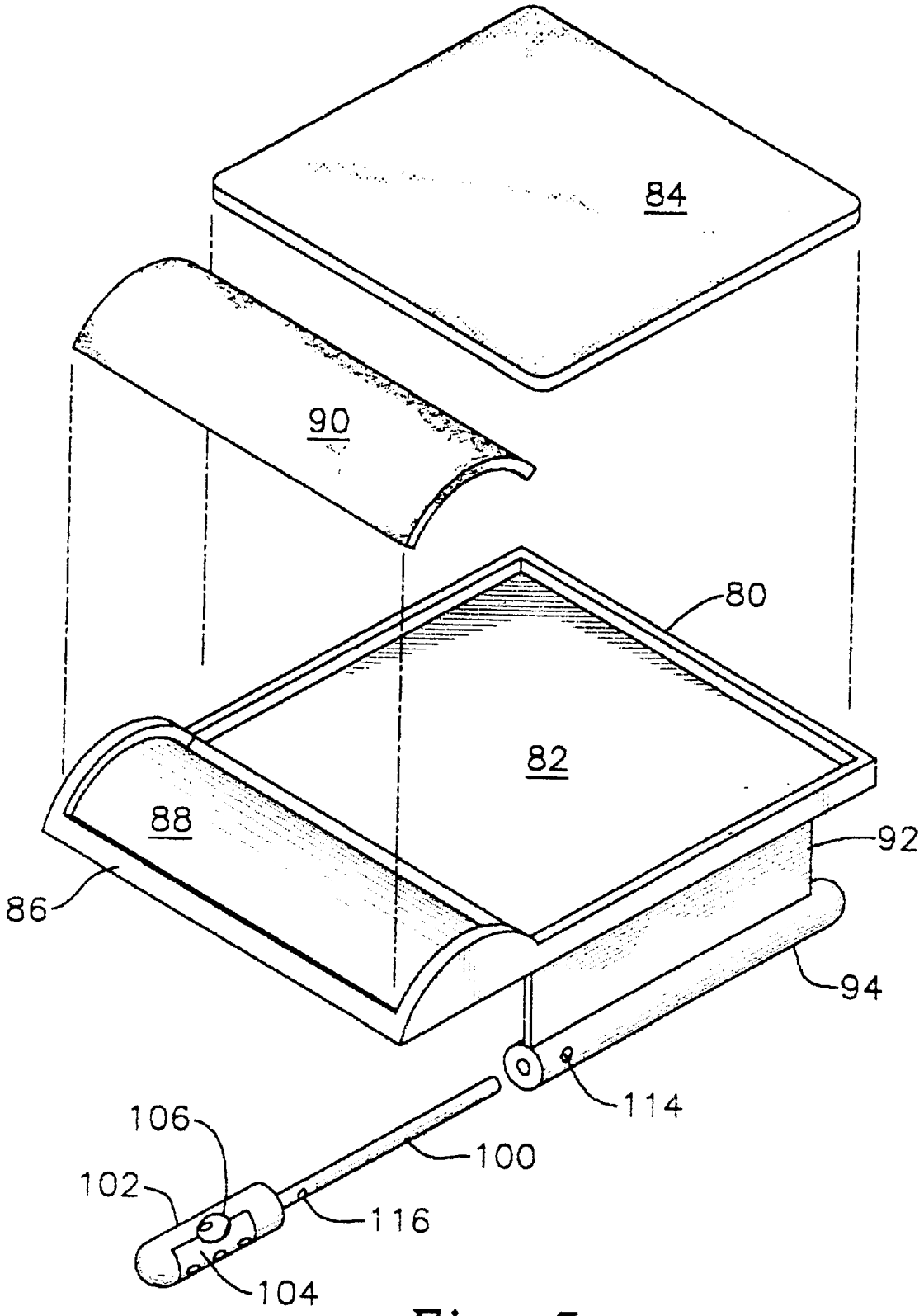
FIG. 5 is an exploded perspective view of the novel structure for supporting a computer mouse.

Assembly 32 for supporting a computer mouse is best depicted in FIG. 5. The novel assembly includes a flat platform 80 having a recessed top wall 82 to accommodate a mouse pad 84; the depth of the recess is substantially equal to the thickness of the mouse pad. Assembly 32 further includes a rounded wrist-supporting member 86 formed integrally with platform 80. Wrist-supporting member 86 has a recessed top wall 88 to accommodate a cushioned wrist pad 90; the depth of the recess is substantially equal to the thickness of the wrist pad.

Flat mounting plate 92 depends from a preselected edge of platform 80 and an elongate mounting tube 94 is secured to a bottom edge of said mounting plate. In FIG. 5, mounting plate 92 depends from the right edge of platform 80; this is the right-handed embodiment of mouse support structure 32. The mounting plate would depend from the left edge of platform 80 to provide a mouse support structure for a left-handed mouse user, and mouse-supporting structure 32 would then be attached to the left armrest of chair 12.

Figure 6:
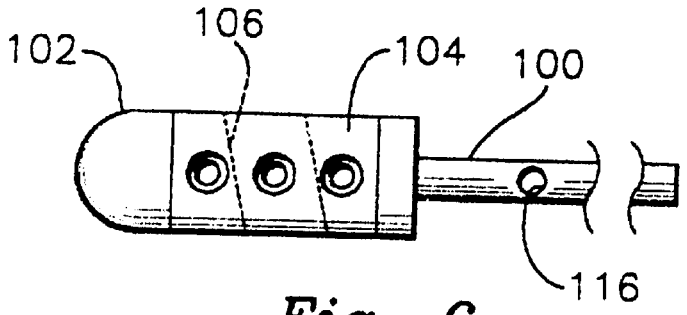
FIG. 6 is a broken apart side elevational view of a support arm that forms a part of the structure for supporting the mouse.
Figure 7:
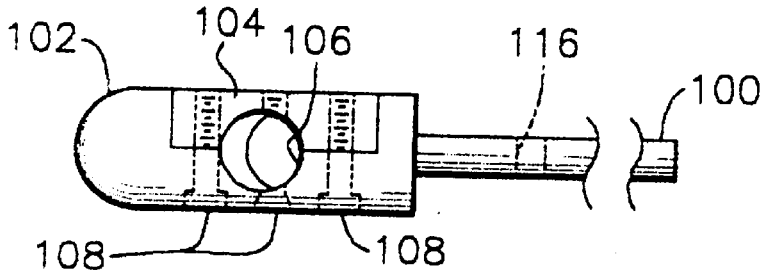
FIG. 7 is a broken apart top plan view of the support arm depicted in FIG. 6.

Elongate arm 100 interconnects mouse support assembly 32 to the forward section of a preselected armrest of chair 12. Elongate arm 100 includes a base 102 at its proximal end having a cut-out part 104. As best indicated in FIGS. 6 and 7, a throughbore 106 extends through base 102 at a preselected angle, with half of said throughbore being formed in base 102 and half in cut-out part 104. Cut-out part 104 is internally threaded as depicted and screws 108 secure cut-out part 104 to said base 102 when said preselected front section of armrest 18 is captured between said base 102 and said cut-out part 104. The angle of throughbore 106 is preselected to offset the angle of the armrest so that mouse support platform 80 is disposed in a substantially horizontal plane as depicted in FIG. 1.

Figure 8:
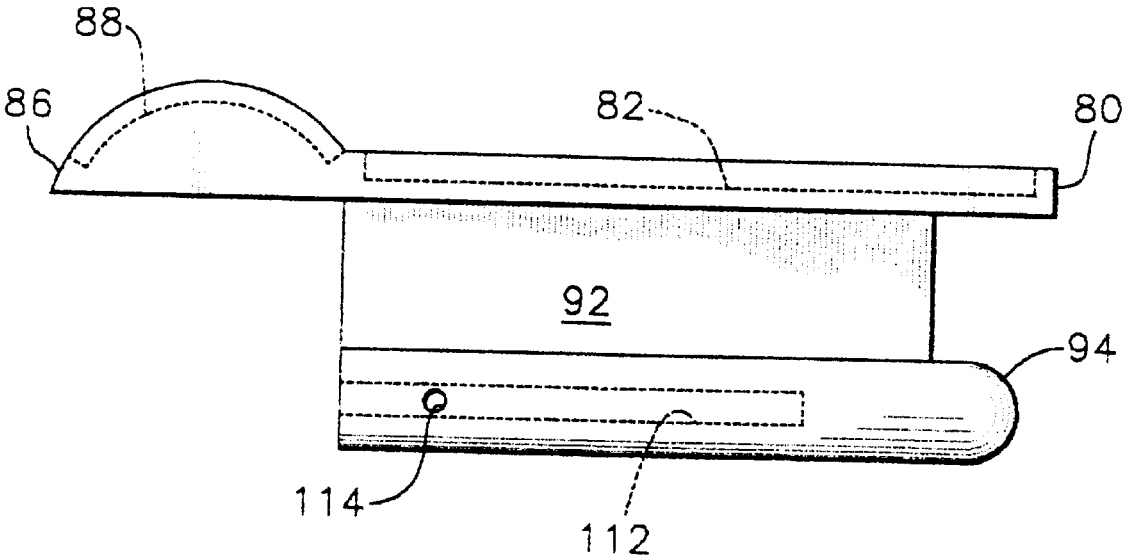
FIG. 8 is a side elevational view of the mouse-supporting platform.

Elongate rod 100 extends longitudinally from base 102 and is slideably received within a blind bore 112 (FIG. 8) formed in mounting tube 94. As depicted in FIG. 5, a transversely-extending throughbore 114 is formed in mounting tube 94 and a similar throughbore 116 is formed in elongate rod 100. As perhaps best understood in connection with FIGS. 5 and 8, when elongate rod 100 is fully slideably received within blind bore 112, throughbores 114 and 116 align with one another and a cotter pin (not shown) or the like extended through said throughbores prevents relative rotation between mounting tube 94 and elongate rod 100. Thus, platform 80 is maintained in cantilevered relation to flat mounting plate 92. The cotter pin or similar pin means provides the needed anti-rotation means to prevent rotation of platform 80 about elongate rod 100 so that a mouse supported atop pad 84 is conveniently positioned for the user of the novel chair.

This invention represents a major breakthrough in the art of computer work stations. Being drawn to a pioneering invention, the claims that follow are entitled, as a matter of law, to broad interpretation to protect the heart or essence of the invention from piracy.

It will thus be seen that the objects set forth above, and those made apparent from the foregoing description, are efficiently attained. Since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An assembly adapted for attachment to a chair, comprising:

a first platform adapted to support a computer keyboard;

a second platform adapted to support a computer mouse;

said first platform adapted to be releasably secured to a preselected arm of said chair;

said second platform adapted to be releasably secured to a preselected arm of said chair;

a pivot means for supporting said first platform;

said pivot means having a first part for enabling pivoting of said first platform in a substantially horizontal plane;

said first platform adapted for having a first position where it is disposed transversely relative to said chair so that a computer keyboard adapted to be supported thereby is positioned directly in front of a user seated in said chair;

said first platform adapted for having a second position where it is disposed longitudinally relative to said chair to enable a person seated in said chair to exit said chair and to enable a person not seated in said chair to enter said chair;

said pivot means having a second part enabling said first platform to rotate about a substantially horizontal axis so that a user of said computer keyboard may rotate said first platform into a preselected plane that is tilted by any preselected degree relative to a horizontal plane;

an elongate support arm having a proximal end adapted to be secured to said preselected arm of said chair;

said elongate support arm having a distal end;

said pivot means secured to said distal end;

said pivot means being a bracket having an "L"-shaped structure and including a substantially horizontal first part and a substantially vertical second part;

a support plate disposed in a substantially horizontal plane in underlying, supporting relation to said first platform;

a mounting ear depending from a preselected longitudinal edge of said support plate;

said mounting ear pivotally engaging said substantially vertical part of said bracket so that said support plate and hence said first platform are conjointly rotatable about said substantially horizontal axis;

said substantially horizontal first part of said bracket being pivotally engaged to said distal end of said elongate support arm so that said support plate and hence said first platform are conjointly rotatable about a substantially vertical axis and thus conjointly pivotal in said substantially horizontal plane;

whereby a person seated on said chair may operate said computer keyboard and said computer mouse while seated in said chair; and whereby said person may sit comfortably in said chair in any desired posture or orientation without regard to a physical placement of a computer means and a computer monitor means with which said computer keyboard and computer mouse are associated.

2. The assembly of claim 1, further comprising:

a flat mounting plate depending from a preselected edge of said second platform;

an elongate mounting tube having a blind bore formed therein secured to a bottom edge of said flat mounting plate;

an elongate rod slideably received within said blind bore;

a base member to which said elongate rod is secured, said base member being adapted to releasably engage a preselected armrest of said chair; and anti-rotation means to prevent rotation of said second platform about said elongate rod.

3. The assembly of claim 2, wherein said anti-rotation means includes a first transversely disposed throughbore that intersects said blind bore, a second transversely disposed throughbore that is formed in said elongate rod, and a pin means that extends through said first and second transversely disposed throughbores.

* * * * *